US010794240B2

(12) United States Patent
Miyata

(10) Patent No.: US 10,794,240 B2
(45) Date of Patent: Oct. 6, 2020

(54) INTERNAL COMBUSTION ENGINE AND STRADDLED VEHICLE HAVING THE SAME

(71) Applicant: YAMAHA HATSUDOKI KABUSHIKI KAISHA, Iwata-shi, Shizuoka-ken (JP)

(72) Inventor: Manabu Miyata, Iwata (JP)

(73) Assignee: YAMAHA HATSUDOKI KABUSHIKI KAISHA, Iwata-Shi, Shizuoka-Ken (JP)

( * ) Notice: Subject to any disclaimer, the term of this patent is extended or adjusted under 35 U.S.C. 154(b) by 0 days.

(21) Appl. No.: 16/186,475

(22) Filed: Nov. 9, 2018

(65) Prior Publication Data

US 2019/0153911 A1 May 23, 2019

(30) Foreign Application Priority Data

Nov. 17, 2017 (JP) ..... 2017-221913

(51) Int. Cl.

| | |
|---|---|
| ***F01L 1/46*** | (2006.01) |
| ***F01L 3/08*** | (2006.01) |
| ***F01L 3/10*** | (2006.01) |
| ***F02F 1/42*** | (2006.01) |
| *F01L 1/053* | (2006.01) |
| *F01L 1/14* | (2006.01) |

(52) U.S. Cl.

CPC ..... *F01L 1/462* (2013.01); *F01L 3/08* (2013.01); *F01L 3/10* (2013.01); *F02F 1/4285* (2013.01); *F01L 1/143* (2013.01); *F01L 2001/0537* (2013.01); *F01L 2250/02* (2013.01)

(58) Field of Classification Search

CPC ..... F01L 1/0532; F01L 1/462

USPC ..... 123/90.65, 90.67

See application file for complete search history.

(56) References Cited

U.S. PATENT DOCUMENTS

| | | | | |
|---|---|---|---|---|
| 2,650,086 A * | 8/1953 | Sjolander | F01L 1/462 267/135 |
| 3,021,826 A * | 2/1962 | Peak | F01L 1/26 123/90.4 |
| 4,017,062 A * | 4/1977 | Zwirner | F01L 1/462 267/166 |
| 5,246,215 A * | 9/1993 | Takamura | F01L 1/462 267/170 |

(Continued)

FOREIGN PATENT DOCUMENTS

| | | | |
|---|---|---|---|
| CA | 2222979 A1 * | 8/1999 | F01L 1/053 |
| EP | 2492460 A2 | 8/2012 | |

(Continued)

*Primary Examiner* — Jorge L Leon, Jr.
(74) *Attorney, Agent, or Firm* — Rabin & Berdo, P.C.

(57) ABSTRACT

An internal combustion engine 5 includes an intake valve spring 60 including a closely-wound section 62 and a sparsely-wound section 63. The closely-wound section 62 is provided so that elemental wire portions thereof are closely in contact with each other in the direction of the coil axial line L1 while an intake valve closes an intake port. The sparsely-wound section 63 is provided so that elemental wire portions thereof are spaced apart from each other in the direction of the coil axial line L1 while the intake valve closes the intake port. The coil outer diameter D62 of at least a part of the closely-wound section 62 is smaller than the coil outer diameter D63 of at least a part of the sparsely-wound section 63.

13 Claims, 7 Drawing Sheets

(56) References Cited

U.S. PATENT DOCUMENTS

| | | | | |
|---|---|---|---|---|
| 5,596,964 | A * | 1/1997 | Kurihara | F01L 3/10<br>123/188.13 |
| 2010/0139596 | A1* | 6/2010 | Iwata | F01L 1/205<br>123/90.67 |
| 2011/0030642 | A1 | 2/2011 | Nishida et al. | |
| 2011/0146604 | A1* | 6/2011 | Sai | F01L 1/462<br>123/90.66 |

FOREIGN PATENT DOCUMENTS

| | | | |
|---|---|---|---|
| GB | 983024 | A | 2/1965 |
| JP | S60-38107 | U | 3/1985 |
| JP | 2004-169730 | A | 6/2004 |
| JP | 2011-038438 | A | 2/2011 |

* cited by examiner

INTERNAL COMBUSTION ENGINE AND STRADDLED VEHICLE HAVING THE SAME

This application claims the benefit of priority to Japanese Patent Application No. 2017-221913 filed on Nov. 17, 2017. The entire contents of this application are hereby incorporated herein by reference.

BACKGROUND OF THE INVENTION

Field of the Invention

The present invention relates to an internal combustion engine and a straddled vehicle having the same.

Description of the Related Art

As described in Japanese Laid-Open Patent Publication No. 2011-38438, for example, internal combustion engines that include an intake port having an intake opening, an intake valve configured to open and close the intake opening, a valve spring configured to bias the intake valve so as to close the intake opening, and an intake cam configured to push the intake valve so as to periodically open the intake opening, are well known in the art.

FIG. 7 is a partial cross-sectional view showing an example of such an internal combustion engine. An internal combustion engine 100 includes an intake port 101 having an intake opening 101*a*, an intake valve 110 configured to open and close the intake opening 101*a*, a valve spring 120 configured to bias the intake valve 110 so as to close the intake opening 101*a*, and an intake cam 102 configured to push the intake valve 110 so as to periodically open the intake opening 101*a*.

The valve spring 120 is a compression coil spring having a constant coil outer diameter D. Note that a compression coil spring is a helically-wound elemental wire. As the intake cam 102 pushes the intake valve 110, the intake valve 110 moves downward in FIG. 7 to open the intake opening 101*a*. In this process, the valve spring 120 contracts. As the intake cam 102 rotates and the valve spring 120 expands, the intake valve 110 moves upward in FIG. 7 to close the intake opening 101*a*. The valve spring 120 repeatedly contracts and expands as the intake valve 110 opens and closes. The valve spring 120 is always in a compressed state, and there is always a load on the valve spring 120. There is a large load on the valve spring 120 particularly when contracted. With compression coil springs, the larger the coil outer diameter D, the smaller the stress is on the elemental wire. Therefore, the larger the coil outer diameter D, the higher the load bearing capacity of the valve spring 120. The coil outer diameter D of the valve spring 120 is set so that the valve spring 120 can sufficiently withstand the load when contracted. The coil outer diameter D needs to be somewhat large.

The valve spring 120 is supported on a portion (hereinafter referred to as a spring support portion) 151 of a cylinder head 150 with a valve spring seat 103 therebetween. The surface of a spring support portion 151 on which the valve spring seat 103 is placed needs to have an area that is greater than or equal to the area of a circle whose diameter is equal to the coil outer diameter D. Since the coil outer diameter D is relatively large, a part of the spring support portion 151 protrudes into the intake port 101 in order to ensure a sufficient thickness of the spring support portion 151. Therefore, a part 111 of the inner wall of the intake port 101 protrudes toward the center of the intake port 101. Note that a virtual line 112 in FIG. 7 represents the position of the inner wall of the intake port 101 when the part of the spring support portion 151 were not protruding.

SUMMARY OF THE INVENTION

With the internal combustion engine 100 described above, since the part 111 of the inner wall of the intake port 101 is protruding, the flow of the intake air may be disturbed. For this, one may consider raising the position of the valve spring seat 103 and the intake cam 102 so that the part 111 of the inner wall of the intake port 101 does not protrude. This however increases the vertical dimension of the cylinder head 150, thereby increasing the size of the internal combustion engine 100.

Note that this problem may possibly occur not only in the intake port 101 but also in an exhaust port 131.

The present invention has been made in view of the above, and it is an object of the present invention to provide an internal combustion engine with which it is possible to reduce the disturbance of the fluid inside the port or it is possible to reduce the size thereof while maintaining the load bearing capacity of the valve spring.

An internal combustion engine disclosed herein includes a cylinder head, a valve, a first valve spring seat, a second valve spring seat, a valve spring, a valve lifter, and a cam. The cylinder head is provided with a port having an opening that is open toward a combustion chamber. A valve includes a valve stem end, a valve stem extending straight from the valve stem end and slidably supported by the cylinder head, and a valve body provided at a tip portion of the valve stem and placed inside the opening. The first valve spring seat is supported on the cylinder head. The second valve spring seat is supported on the valve stem end of the valve. The valve spring is a compression coil spring placed between the first valve spring seat and the second valve spring seat and supported on first valve spring seat and the second valve spring seat. The valve lifter is supported on the valve stem end. The cam is configured to periodically push the valve lifter as the cam rotates. The valve spring includes an array of elemental wire portions extending in a coil axial line direction, wherein each elemental wire portion represents one helical round of the valve spring. The elemental wire portions include a closely-wound section supported on the first valve spring seat and a sparsely-wound section placed closer to the second valve spring seat than the closely-wound section. The closely-wound section is provided so that elemental wire portions thereof are closely in contact with each other in the direction of the coil axial line while the valve is closed. Said condition is maintained while the internal combustion engine is inoperative and the valve is closed. The sparsely-wound section is provided so that elemental wire portions thereof are spaced apart from each other in the direction of the coil axial line while the valve is closed. Said condition is maintained while the internal combustion engine is inoperative and the valve is closed. The coil outer diameter of at least a part of the closely-wound section is smaller than the coil outer diameter of at least a part of the sparsely-wound section.

According to the internal combustion engine described above, the closely-wound section of the valve spring is placed closer to the port than the sparsely-wound section. The coil outer diameter of at least a part of the closely-wound section is smaller than the coil outer diameter of at least a part of the sparsely-wound section. Thus, the coil outer diameter of a portion of the valve spring that is close to the port can be set to a relatively small diameter. Therefore, even if a part of the inner wall of the port is not protruding, it is possible to ensure a sufficient thickness of the spring support portion of the cylinder head. Thus, it is possible to reduce the disturbance of the fluid inside the port by reducing or eliminating the protrusion of the inner wall of the port. Moreover, it is possible to decrease the dimension of the cylinder head by placing the valve spring at a position that is closer to the port. Thus, it is possible to reduce the size of an internal combustion engine.

If one simply uniformly decreases the coil outer diameter of the valve spring, the load bearing capacity of the valve spring will be lowered. That is, if one decreases both the coil outer diameter of the closely-wound section and that of the sparsely-wound section, the load bearing capacity of the valve spring will be lowered. However, with the internal combustion engine described above, the coil outer diameter of the valve spring is small only for at least a part of the closely-wound section. The closely-wound section, which is a section where the elemental wire portions are in close contact with each other in the coil axial line direction, has a high load bearing capacity even if the coil outer diameter is small. Therefore, with the internal combustion engine described above, it is possible to reduce the disturbance of the fluid inside the port or reduce the size of the internal combustion engine while maintaining the load bearing capacity of the valve spring.

According to one embodiment, the coil outer diameter of the closely-wound section gradually decreases toward the first valve spring seat.

According to the embodiment described above, since the coil outer diameter of the closely-wound section changes gradually, there is no possibility that a large stress occurs locally on the closely-wound section, as opposed to an embodiment in which the coil outer diameter changes abruptly. It is possible to sufficiently ensure a sufficient load bearing capacity of the valve spring.

According to another embodiment, the first valve spring seat is a flat washer.

With the embodiment described above, it is possible to simplify, and reduce the cost of, the first valve spring seat.

According to another embodiment, the internal combustion engine includes a cylindrical valve guide supported on the cylinder head. The valve stem is slidably inserted through the valve guide. A part of the valve guide is placed inside the closely-wound section of the valve spring. A coil inner diameter of at least a part of the closely-wound section is equal to an outer diameter of the valve guide.

According to the embodiment described above, at least a part of the closely-wound section is fitted over the valve guide. At least a part of the closely-wound section is in contact with the outer surface of the valve guide. The valve guide restricts the movement in the transverse direction of the closely-wound section. Therefore, the valve spring is prevented from moving off the coil axial line (=the center of the valve guide) when the valve spring contracts and expands. Therefore, the valve spring desirably contracts and expands along the axial direction of the valve stem.

According to another embodiment, the valve spring has characteristics that satisfy: $P=k1\cdot\delta$ when load P is 0 or more and less than first load P1; and $P=k2\cdot\delta$ when load P is greater than or equal to first load P1, where P denotes load, $\delta$ denotes deformation, and k2 denotes a constant greater than a constant k1.

According to another embodiment, when a load is applied on the valve spring in a natural length state, the closely-wound section contracts while the sparsely-wound section does not contract so that elemental wire portions of the closely-wound section come into close contact with each other, after which the sparsely-wound section contracts.

According to another embodiment, the port is an intake port that guides intake air into the combustion chamber.

According to the embodiment described above, it is possible to reduce the disturbance of the intake air in the intake port. Thus, it is possible to increase the amount of intake air for the combustion chamber and to optimize the flow of the intake air in the combustion chamber, thereby improving the performance of the internal combustion engine.

According to another embodiment, the internal combustion engine includes a cylinder body that is connected to the cylinder head and includes a cylinder defining a part of the combustion chamber. The opening is an intake opening through which the intake air is guided from the intake port into the combustion chamber. The intake port includes an inlet opening that is an opening on an opposite side to the intake opening. On a cross section of the cylinder head that passes through a center line of the cylinder and a center line of the inlet opening, an angle formed between the center line of the cylinder and the center line of the inlet opening is 60 degrees or less.

As the angle is smaller, the distance between the intake port and the valve spring tends to be shorter. According to the embodiment described above, the above-described effect that a sufficient thickness of the spring support portion of the cylinder head can be ensured even with no protrusion on a part of the inner wall of the port is more pronounced.

According to another embodiment, the valve spring is formed from a single helically-wound elemental wire.

A straddled vehicle disclosed herein is a straddled vehicle including the internal combustion engine.

According to the present invention, it is possible to provide an internal combustion engine with which it is possible to reduce the disturbance of the fluid inside the port or it is possible to reduce the size thereof while maintaining the load bearing capacity of the valve spring.

DETAILED DESCRIPTION OF THE PREFERRED EMBODIMENTS

Figure 1:
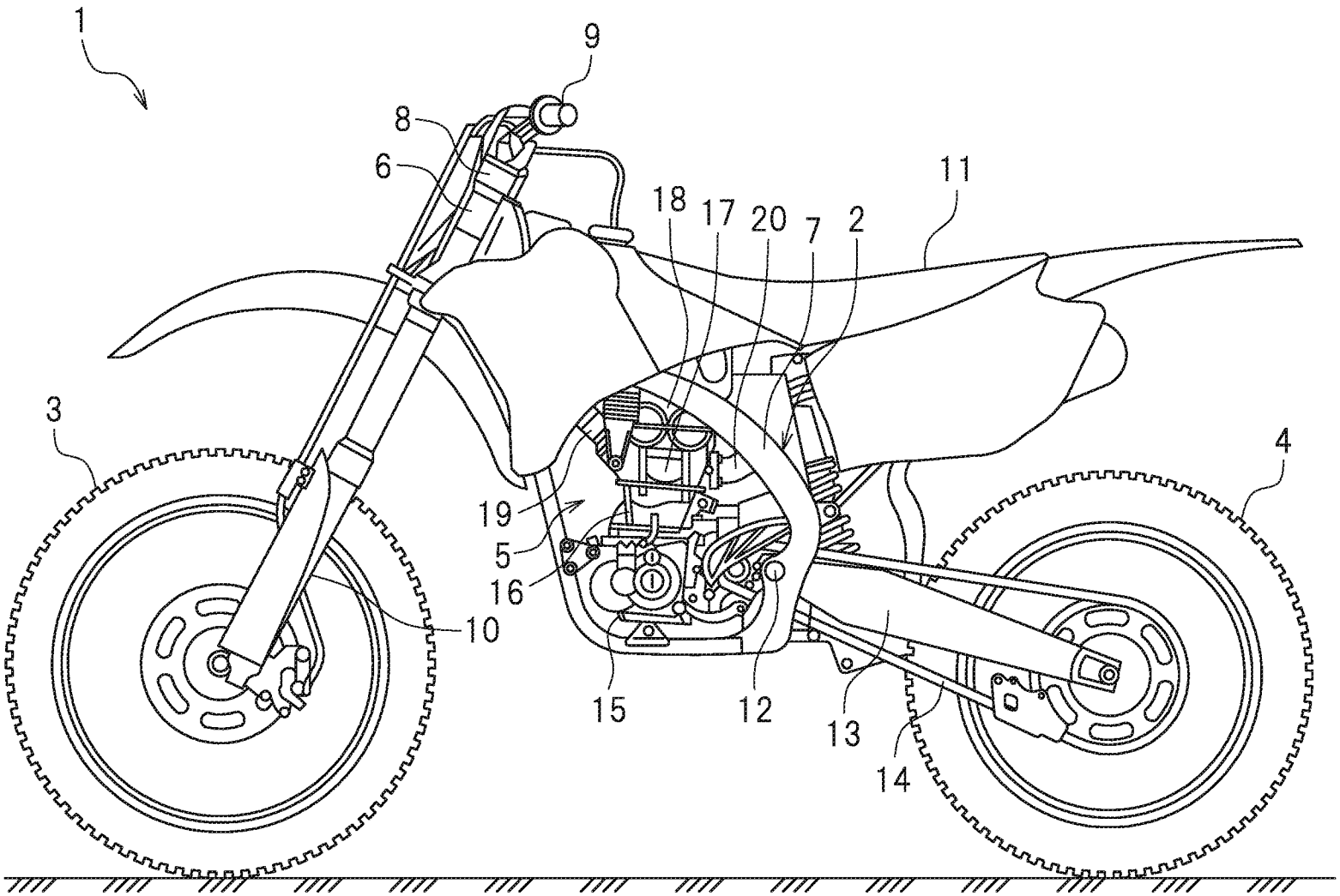
FIG. 1 is a side view showing a motorcycle according to an embodiment.

One embodiment of the present invention will now be described with reference to the drawings. A motorcycle 1 shown in FIG. 1 will now be described as an example of a straddled vehicle.

The motorcycle 1 includes a body frame 2, an internal combustion engine (hereinafter referred to as an engine) 5 supported on the body frame 2, a seat 11 supported on the body frame 2, a front wheel 3, and a rear wheel 4. The body frame 2 includes a head pipe 6, and a main frame 7 extending rearward from the head pipe 6. The engine 5 is supported on the main frame 7. A steering shaft 8 is supported on the head pipe 6 so that the steering shaft 8 can rotate left and right. A handle 9 is fixed on an upper portion of the steering shaft 8. A front fork 10 is provided on a lower portion of the steering shaft 8. The front wheel 3 is rotatably supported on the front fork 10. The main frame 7 is provided with a pivot shaft 12. A front end portion of a rear arm 13 is pivotally connected to the pivot shaft 12. The rear wheel 4 is supported on the rear end portion of the rear arm 13. The rear wheel 4 and the engine 5 are linked together by a chain 14, which is an example of a power transmission member.

The engine 5 includes a crankcase 15 accommodating a crankshaft (not shown) therein, a cylinder body 16 connected to the crankcase 15, a cylinder head 17 connected to the cylinder body 16, and a cylinder head cover 18 connected to the cylinder head 17. A cylinder 16*a* (see FIG. 2) is provided inside the cylinder body 16. A piston (not shown) is placed inside the cylinder 16*a*. The piston and the crankshaft are linked together by a connecting rod (not shown). An intake pipe 19 and an exhaust pipe 20 are connected to the cylinder head 17.

Figure 2:
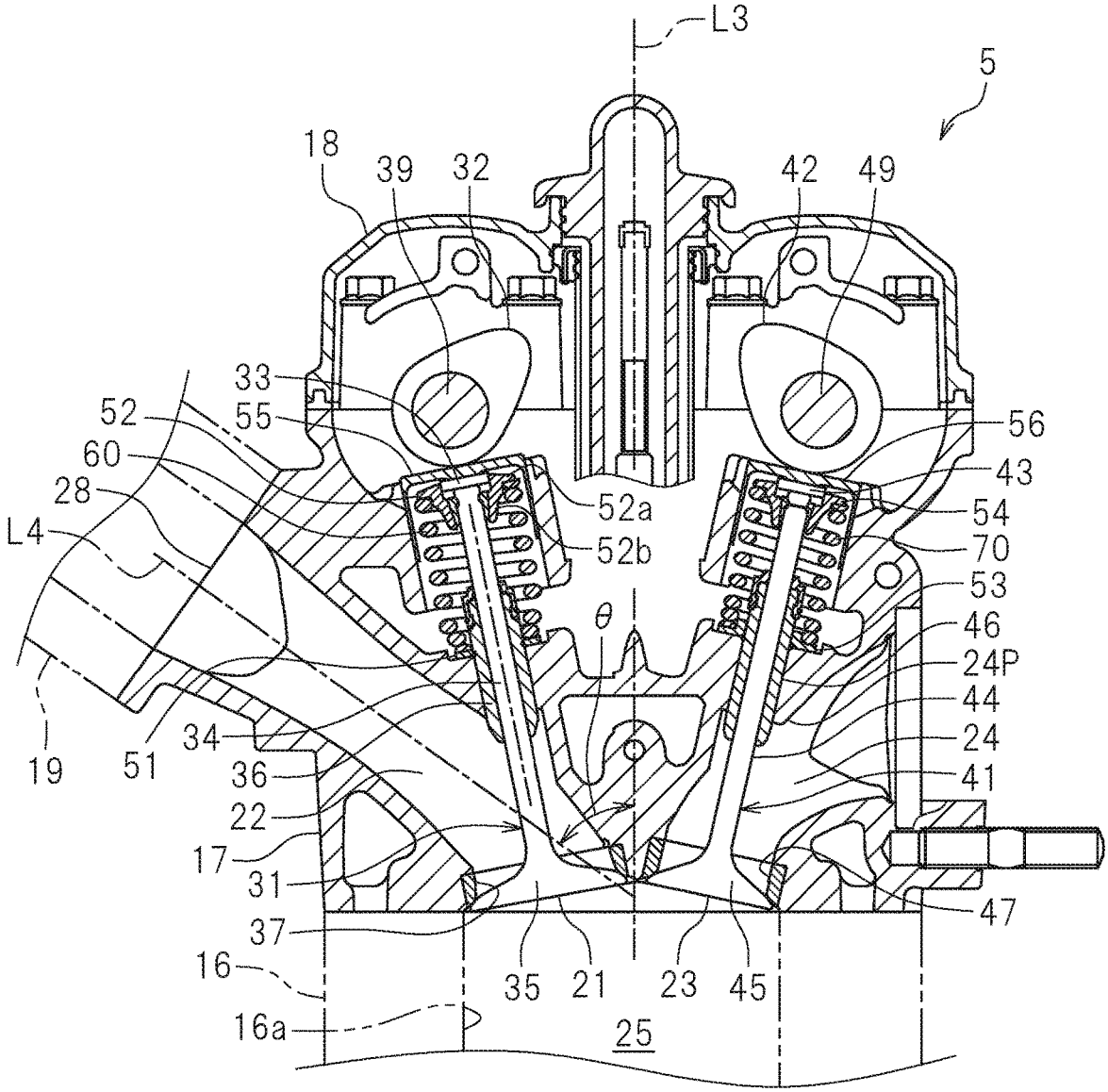
FIG. 2 is a cross-sectional view showing a part of an internal combustion engine according to an embodiment.

FIG. 2 is a cross-sectional view showing a part of the engine 5. As shown in FIG. 2, the cylinder head 17 is provided with an intake port 22 having an intake opening 21 that is open toward a combustion chamber 25, and an exhaust port 24 having an exhaust opening 23 that is open toward the combustion chamber 25. The engine 5 includes an intake valve 31, an exhaust valve 41, an intake cam 32, and an exhaust cam 42.

The intake valve 31 opens and closes the intake opening 21. The intake valve 31 is a so-called "poppet valve". The intake valve 31 includes a valve stem end 33, a valve stem 34 extending straight from the valve stem end 33, and a valve body 35 provided at the tip portion of the valve stem 34. A cylindrical valve guide 36 is fitted in the cylinder head 17. The valve stem 34 is inserted through, and slidably supported by, the valve guide 36. The valve stem 34 is slidably supported indirectly by the cylinder head 17 with the valve guide 36 therebetween. The valve body 35 is mushroom-shaped. The valve body 35 is placed inside the intake opening 21. A valve seat 37 is fitted in the intake opening 21. The valve body 35 is configured to open the intake opening 21 by moving apart from the valve seat 37, and close the intake opening 21 by moving into close contact with the valve seat 37.

A first valve spring seat 51 is supported on the cylinder head 17. The first valve spring seat 51 is a flat washer. The first valve spring seat 51 is formed in a flat ring shape. The valve guide 36 is inserted through the first valve spring seat 51. The valve guide 36 extends through the first valve spring seat 51. A second valve spring seat 52 is supported on the valve stem end 33. The second valve spring seat 52 includes a flat annular portion 52*a*, and a cylindrical portion 52*b* extending toward the first valve spring seat 51 from the annular portion 52*a*.

Figure 3:
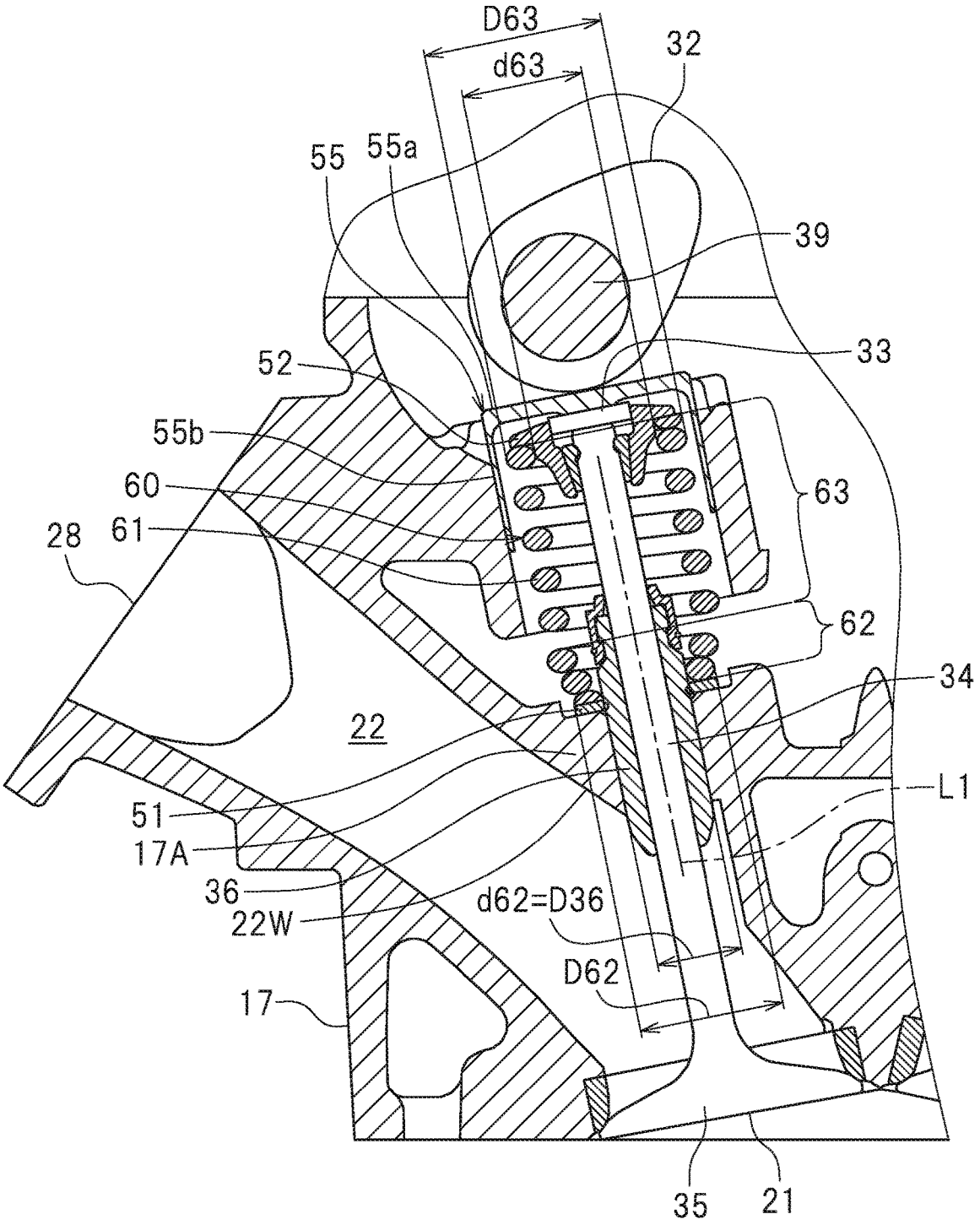
FIG. 3 is an enlarged cross-sectional view showing the vicinity of the intake port of the internal combustion engine.

As shown in FIG. 3, the engine 5 includes an intake valve spring 60 placed between the first valve spring seat 51 and the second valve spring seat 52. The intake valve spring 60 is supported on the first valve spring seat 51 and the second valve spring seat 52. The intake valve spring 60 is a compression coil spring. The intake valve spring 60 is formed from a single helically-wound elemental wire 61. The intake valve spring 60 is formed from a single seamless elemental wire 61. Where each round of the helical winding of the elemental wire 61 is referred to as an elemental wire portion, the intake valve spring 60 can be said to include an array of elemental wire portions extending in the direction of the coil axial line L1.

The plurality of elemental wire portions include a closely-wound section 62 supported on the first valve spring seat 51, and a sparsely-wound section 63 that is placed closer to the second valve spring seat 52 than the closely-wound section 62. The closely-wound section 62 is provided so that elemental wire portions thereof are closely in contact with each other in the direction of the coil axial line L1 while the valve is closed. Said condition is maintained while the internal combustion engine is inoperative and the valve is closed. The sparsely-wound section 63 is provided so that elemental wire portions thereof are spaced apart from each other in the direction of the coil axial line L1 while the valve is closed. Said condition is maintained while the internal combustion engine is inoperative and the valve is closed. The coil outer diameter D62 of at least a part of the closely-wound section 62 is smaller than the coil outer diameter D63 of at least a part of the sparsely-wound section 63. Note that the coil outer diameter refers to the distance between outer radial edges of two portions of an elemental wire portion that are located on the opposite sides from each other with respect to the coil axial line L1. The coil inner diameter to be described below refers to the distance between inner radial edges of two portions of an elemental wire portion that are located on the opposite sides from each other with respect to the coil axial line L1.

In the present embodiment, the coil outer diameter D63 of the sparsely-wound section 63 is constant. The coil outer diameter D62 of the closely-wound section 62 decreases toward the first valve spring seat 51. Herein, the coil outer diameter D62 of the closely-wound section 62 gradually decreases toward the first valve spring seat 51. In other words, the coil outer diameter D62 decreases continuously. A portion of the intake valve spring 60 close to the first valve spring seat 51 is barrel-shaped. Note however that the coil outer diameter D62 may decrease non-continuously. For example, the coil outer diameter D62 may decrease stepwise.

From the second valve spring seat 52 toward the first valve spring seat 51, the intake valve spring 60 includes a portion having a constant coil outer diameter D63 and another portion having a smaller coil outer diameter than the coil outer diameter D63. In the present embodiment, the portion having a constant coil outer diameter D63 is the sparsely-wound section 63, and the portion having a smaller coil outer diameter than the coil outer diameter D63 is the closely-wound section 62. However, the portion having a constant coil outer diameter D63 may be a part of the sparsely-wound section 63, and the portion having a smaller coil outer diameter than the coil outer diameter D63 may be the rest of the sparsely-wound section 63 and the closely-wound section 62. Alternatively, the portion having a constant coil outer diameter D63 may be the sparsely-wound section 63 and a part of the closely-wound section 62, and the portion having a smaller coil outer diameter than the coil outer diameter D63 may be the rest of the closely-wound section 62.

Figure 4:
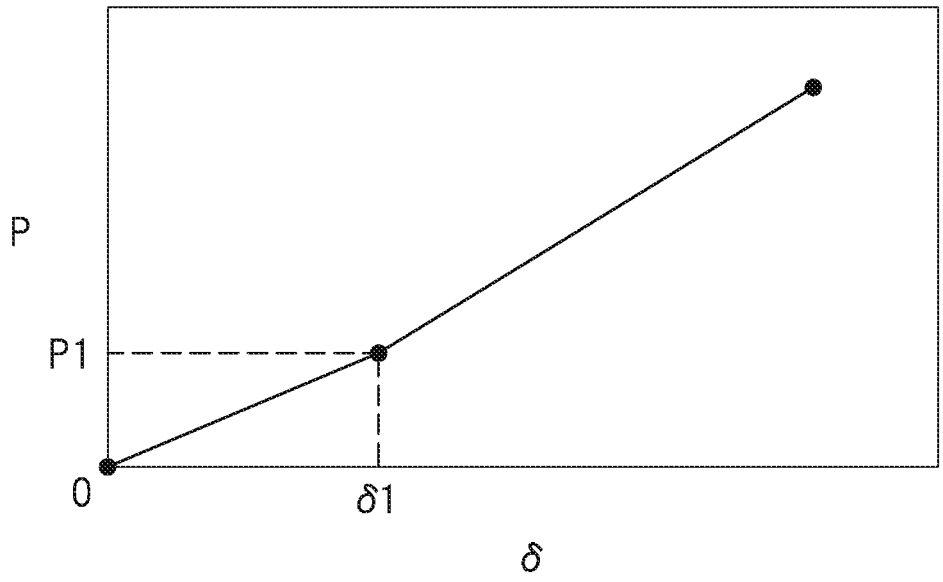
FIG. 4 is a graph showing characteristics of the intake valve spring.

Next, the characteristics of the intake valve spring 60 will be described. FIG. 4 is a graph showing characteristics of the intake valve spring 60. The horizontal axis δ and the vertical axis P of the graph of FIG. 4 represent the deformation and the load, respectively. As shown in FIG. 4, the intake valve spring 60 has characteristics that satisfy:

$P=k1\cdot\delta$ when load P is 0 or more and less than first load P1; and $P=k2\cdot\delta$ when load P is greater than or equal to first load P1.

where k1 is a constant, and k2 is a constant greater than k1. Thus, the intake valve spring 60 has two spring constants, and has such characteristics that the spring constant changes after a certain point.

When a load greater than or equal to the first load P1 is applied on the intake valve spring 60 in the natural length state (i.e., where the load is 0), the closely-wound section 62 contracts until the deformation δ is δ1, at which point the elemental wire portions of the closely-wound section 62 are in close contact with each other. Thereafter, with the elemental wire portions of the closely-wound section 62 being in close contact with each other, the sparsely-wound section 63 contracts. That is, when a load that is greater than or equal to the first load P1 is applied on the intake valve spring 60 in the natural length state, first, the closely-wound section 62 contracts and the sparsely-wound section 63 does not contract so that the elemental wire portions of the closely-wound section 62 come into close contact with each other, after which the sparsely-wound section 63 contracts.

The intake valve spring 60, as built in the engine 5, is under a load that is greater than or equal to the first load P1. That is, the intake valve spring 60 is compressed by being supported on the first valve spring seat 51 and the second valve spring seat 52 to be under a load that is greater than or equal to the first load P1. Therefore, with the intake valve spring 60 built in the engine 5, the elemental wire portions of the closely-wound section 62 are in close contact with each other and the elemental wire portions of the sparsely-wound section 63 are spaced apart from each other while the valve is closed. Said condition is maintained while the internal combustion engine is inoperative and the valve is closed.

As shown in FIG. 3, a part of the valve guide 36 is placed inside the closely-wound section 62 of the intake valve spring 60. The coil inner diameter d62 of at least a part of the closely-wound section 62 is equal to the outer diameter D36 of the valve guide 36. At least a part of the closely-wound section 62 is in contact with the outer surface of the valve guide 36. At least a part of the closely-wound section 62 is fitted over the valve guide 36. Note that the coil inner diameter d63 of the sparsely-wound section 63 is greater than the outer diameter D36 of the valve guide 36. The sparsely-wound section 63 is not in contact with the outer surface of the valve guide 36.

A valve lifter 55 is supported on the valve stem end 33. The valve lifter 55 includes a disc portion 55*a*, and a cylindrical portion 55*b* extending from the disc portion 55*a* toward the first valve spring seat 51. A part of the sparsely-wound section 63 of the intake valve spring 60 is placed inside the cylindrical portion 55*b*.

The valve lifter 55 is in contact with the intake cam 32. The intake cam 32 pushes the valve lifter 55 toward the first valve spring seat 51. The intake cam 32 is provided on an intake camshaft 39. Although not shown in the figures, the intake camshaft 39 is linked to the crankshaft via a cam chain. The intake camshaft 39 rotates together with the crankshaft. The intake cam 32 rotates together with the rotation of the intake camshaft 39.

As shown in FIG. 2, the exhaust valve 41 opens and closes the exhaust opening 23. The exhaust valve 41 is a poppet valve, as is the intake valve 31. The exhaust valve 41 includes a valve stem end 43, a valve stem 44 extending straight from the valve stem end 43, and a mushroom-shaped valve body 45 provided at the tip portion of the valve stem 44. A cylindrical valve guide 46 is fitted in the cylinder head 17, and the valve stem 44 is slidably supported by the valve guide 46. The valve body 45 is placed inside the exhaust opening 23. A valve seat 47 is fitted in the exhaust opening 23. The valve body 45 is configured to open the exhaust opening 23 by moving apart from the valve seat 47, and close the exhaust opening 23 by moving into close contact with the valve seat 47.

Figure 5:
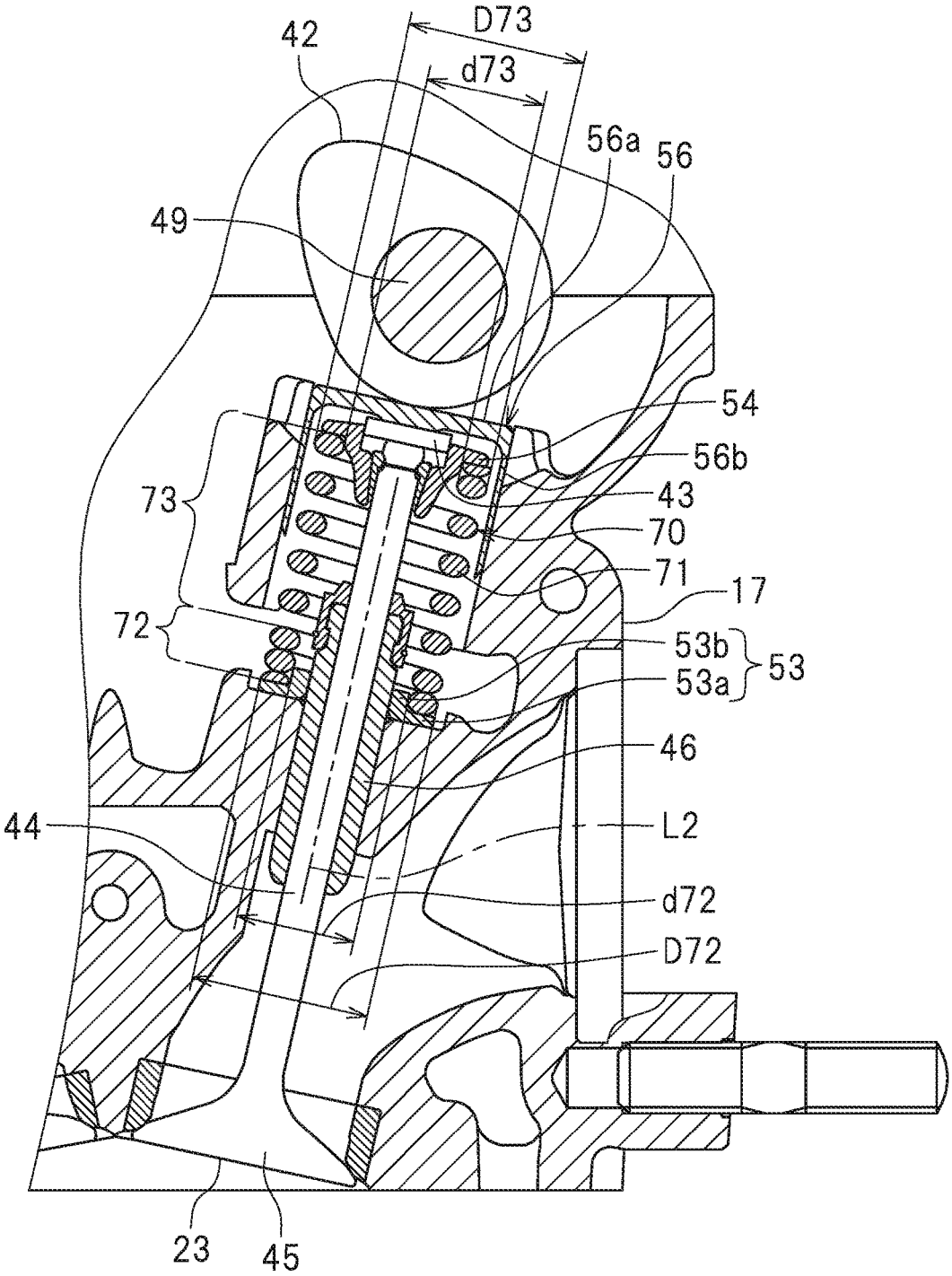
FIG. 5 is an enlarged cross-sectional view showing the vicinity of the exhaust port of the internal combustion engine.

As shown in FIG. 5, a third valve spring seat 53 is supported on the cylinder head 17. The third valve spring seat 53 includes a flat annular portion 53*a*, and a cylindrical portion 53*b* extending in the axial direction of the valve stem 44 from the annular portion 53*a*. The valve guide 46 is inserted through the third valve spring seat 53. A fourth valve spring seat 54 is supported on the valve stem end 43. The fourth valve spring seat 54 has a similar shape to the second valve spring seat 52.

The engine 5 includes an exhaust valve spring 70 placed between the third valve spring seat 53 and the fourth valve spring seat 54. The exhaust valve spring 70 is a compression coil spring and is supported on the third valve spring seat 53 and the fourth valve spring seat 54. The exhaust valve spring 70 is formed from a single helically-wound elemental wire 71. Where each round of the helical winding of the elemental wire 71 is referred to as an elemental wire portion, the exhaust valve spring 70 can be said to include an array of elemental wire portions extending in the direction of the coil axial line L2.

The plurality of elemental wire portions include a closely-wound section 72 supported on the third valve spring seat 53, and a sparsely-wound section 73 that is placed closer to the fourth valve spring seat 54 than the closely-wound section 72. The closely-wound section 72 is provided so that elemental wire portions thereof are closely in contact with each other in the direction of the coil axial line L2 while the valve is closed. Said condition is maintained while the internal combustion engine is inoperative and the valve is closed. The sparsely-wound section 73 is provided so that elemental wire portions thereof are spaced apart from each other in the direction of the coil axial line L2 while the valve is closed. Said condition is maintained while the internal combustion engine is inoperative and the valve is closed. As opposed to the intake valve spring 60, the exhaust valve spring 70 is formed with a constant coil outer diameter. The coil outer diameter D72 of the closely-wound section 72 is equal to the coil outer diameter D73 of the sparsely-wound section 73. The coil inner diameter d72 of the closely-wound section 72 is equal to the coil inner diameter d73 of the sparsely-wound section 73. The coil inner diameter d72 of the closely-wound section 72 is equal to the outer diameter of the cylindrical portion 53*b* of the third valve spring seat 53.

A valve lifter 56 is supported on the valve stem end 43. The valve lifter 56 includes a disc portion 56*a*, and a cylindrical portion 56*b* extending from the disc portion 56*a* toward the third valve spring seat 53. A part of the exhaust valve spring 70 is placed inside the cylindrical portion 56*b*.

The valve lifter 56 is in contact with the exhaust cam 42. The exhaust cam 42 pushes the valve lifter 56 toward the third valve spring seat 53. The exhaust cam 42 is provided on an exhaust camshaft 49. Although not shown in the figures, the exhaust camshaft 49 is linked to the crankshaft via a cam chain. The exhaust camshaft 49 rotates together with the crankshaft. The exhaust cam 42 rotates together with the rotation of the exhaust camshaft 49.

As shown in FIG. 2, the intake port 22 has an inlet opening 28, which is the opening on the opposite side to the intake opening 21. In the present embodiment, on a cross section of the cylinder head 17 that passes through the center line (hereinafter referred to as a cylinder axial line) L3 of the cylinder 16*a* and the center line L4 of the inlet opening 28, the angle θ formed between the cylinder axial line L3 and the center line L4 of the inlet opening 28 is 60 degrees or less. Note however that the present embodiment is merely an example, and the angle θ does not need to be 60 degrees or less.

The engine 5 of the present embodiment is configured as described above. Next, the operation of the intake valve 31 and the exhaust valve 41 will be described.

As the intake cam 32 rotates, the intake cam 32 periodically pushes the valve lifter 55 toward the first valve spring seat 51. When the force with which the intake cam 32 pushes the valve lifter 55 becomes greater than the force with which the intake valve spring 60 pushes the second valve spring seat 52 toward the intake cam 32, the intake valve 31 moves downward in FIG. 2. As a result, the valve body 35 of the intake valve 31 comes apart from the valve seat 37 to open the intake opening 21. Therefore, air is sucked in through the intake port 22 toward the combustion chamber 25. When the force with which the intake cam 32 pushes the valve lifter 55 becomes smaller than the force with which the intake valve spring 60 pushes the second valve spring seat 52 toward the intake cam 32, the intake valve 31 moves upward in FIG. 2. As a result, the valve body 35 of the intake valve 31 comes into close contact with the valve seat 37 to close the intake opening 21.

As the exhaust cam 42 rotates, the exhaust cam 42 periodically pushes the valve lifter 56 toward the third valve spring seat 53. When the force with which the exhaust cam 42 pushes the valve lifter 56 becomes greater than the force with which the exhaust valve spring 70 pushes the fourth valve spring seat 54 toward the exhaust cam 42, the exhaust valve 41 moves downward in FIG. 2. As a result, the valve body 45 of the exhaust valve 41 comes apart from the valve seat 47 to open the exhaust opening 23. Therefore, the exhaust gas flows out from the combustion chamber 25 toward the exhaust port 24. When the force with which the exhaust cam 42 pushes the valve lifter 56 becomes smaller than the force with which the exhaust valve spring 70 pushes the fourth valve spring seat 54 toward the exhaust cam 42, the exhaust valve 41 moves upward in FIG. 2. As a result, the valve body 45 of the exhaust valve 41 comes into close contact with the valve seat 47 to close the exhaust opening 23.

As the intake cam 32 rotates, the intake valve 31 repeatedly opens and closes the intake opening 21. The intake valve 31 repeatedly moves downward and upward in FIG. 2. Therefore, the intake valve spring 60 repeatedly contracts and expands. As described above, the intake valve spring 60 includes the closely-wound section 62 and the sparsely-wound section 63 (see FIG. 3). Since the elemental wire portions of the closely-wound section 62 are in close contact with each other, the closely-wound section 62 does not contract and expand even when the intake valve 31 moves. The sparsely-wound section 63 contracts and expands as the intake valve 31 moves.

The intake valve spring 60 is under a load from the intake cam 32. With a compression coil spring that is obtained by spirally winding the elemental wire 61, when there is a load on the compression coil spring in the direction of the coil axial line L1, each portion of the elemental wire 61 of the sparsely-wound section 63 is under a stress in the axial direction according to the load. The sparsely-wound section 63 has characteristics such that the larger the coil outer diameter, the smaller the stress in the axial direction of the elemental wire 61. Therefore, the sparsely-wound section 63 has characteristics such that the greater the coil outer diameter, the higher the load bearing capacity. In order to increase the load bearing capacity of the intake valve spring 60, the coil outer diameter of the sparsely-wound section 63 is preferably as larger as possible.

If the intake valve spring 60 does not include the closely-wound section 62, the sparsely-wound section 63 may possibly surge when for example the rotational speed of the engine 5 becomes high. That is, the vibration of the sparsely-wound section 63 may become unstable. However, when the intake valve spring 60 includes the closely-wound section 62, the closely-wound section 62 serves to reduce the unstable vibration of the sparsely-wound section 63. Therefore, surging is unlikely to occur.

The elemental wire portions of the closely-wound section 62 are in close contact with each other in the direction of the coil axial line L1. Therefore, when there is a load on the closely-wound section 62 in the direction of the coil axial line L1, the closely-wound section 62 as a whole can serve as a single rigid body and support the load. Therefore, even when the coil outer diameter of the closely-wound section 62 is relatively small, it is possible to ensure a sufficient load bearing capacity in the direction of the coil axial line L1 of the closely-wound section 62.

With the engine 5 of the present embodiment, the coil outer diameter D62 of at least a part of the closely-wound section 62 of the intake valve spring 60 is smaller than the coil outer diameter D63 of at least a part of the sparsely-wound section 63. The coil outer diameter of a portion of the intake valve spring 60 that is close to the intake port 22 can be set to a relatively small diameter. Therefore, even if an inner wall 22W of the intake port 22 is not protruding toward the center of the intake port 22, it is possible to ensure a sufficient thickness of a spring support portion 17A of the cylinder head 17. As shown in FIG. 2, a protruding portion 24P that protrudes toward the center of the exhaust port 24 is formed on the inner wall of the exhaust port 24. On the other hand, there is no such protruding portion on the inner wall 22W of the intake port 22. With the engine 5 of the present embodiment, it is possible to reduce the disturbance of the intake air in the intake port 22 by eliminating the protruding portion on the inner wall 22W of the intake port 22. Thus, it is possible to increase the amount of intake air of the combustion chamber 25 or to improve the flow of the intake air in the combustion chamber 25. It is possible to improve the fuel efficiency.

Since the coil outer diameter D63 of the sparsely-wound section 63 is greater than the coil outer diameter D62 of the closely-wound section 62, it is possible to ensure a sufficient load bearing capacity in the direction of the coil axial line L1 of the sparsely-wound section 63. On the other hand, as described above, even through the coil outer diameter D62 of the closely-wound section 62 is small, the load bearing capacity in the direction of the coil axial line L1 of the closely-wound section 62 is high. Therefore, according to the present embodiment, even through the coil outer diameter of a part of the intake valve spring 60 is small, it is possible to ensure a sufficient load bearing capacity in the direction of the coil axial line L1 of the intake valve spring 60. Therefore, with the engine 5 of the present embodiment, it is possible to reduce the disturbance of the intake air in the intake port 22 while maintaining the load bearing capacity of the intake valve spring 60.

Note that in the present embodiment, even though there is no protruding portion on the inner wall 22W of the intake port 22, there may be a protruding portion whose amount of protrusion is smaller than those of conventional techniques on a part of the inner wall 22W. There may be a protruding portion whose amount of protrusion is similar to those of conventional techniques. In such a case, the positions of the first valve spring seat 51, the intake valve spring 60, the second valve spring seat 52, the valve lifter 55, the intake cam 32 and the intake camshaft 39 can be moved closer to the intake opening 21 while ensuring a sufficient thickness of the spring support portion 17A of the cylinder head 17. Thus, it is possible to reduce the dimensions of the cylinder head 17 and the cylinder head cover 18 in the direction of the cylinder axial line L3 (see FIG. 2). It is possible to reduce the dimension of the engine 5 in the vehicle up-down direction. It is possible to reduce the size of the engine 5 while ensuring substantially the same level of performance as those of conventional techniques. Therefore, it is possible to reduce the size of the engine 5 while maintaining the load bearing capacity of the intake valve spring 60.

While the coil outer diameter D62 of the closely-wound section 62 may decrease stepwise toward the first valve spring seat 51, the coil outer diameter D62 decreases gradually in the present embodiment. Since the coil outer diameter D62 of the closely-wound section 62 changes gradually, there is no possibility that a large stress occurs locally on the closely-wound section 62, as opposed to an embodiment in which the coil outer diameter D62 changes abruptly. Therefore, it is possible to ensure a sufficient load bearing capacity of the intake valve spring 60.

With the engine 5 of the present embodiment, the coil inner diameter d62 of at least a part of the closely-wound section 62 is equal to the outer diameter D36 of the valve guide 36. At least a part of the closely-wound section 62 is fitted over the valve guide 36. At least a part of the closely-wound section 62 is in contact with the outer surface of the valve guide 36. The valve guide 36 restricts the movement in the transverse direction of the closely-wound section 62 (the direction perpendicular to the coil axial line L1). Therefore, the intake valve spring 60 is prevented from moving off the coil axial line L1 when the intake valve spring 60 contracts and expands. Therefore, the intake valve spring 60 desirably contracts and expands along the axial direction of the valve stem 34.

With the engine 5 of the present embodiment, since the intake valve spring 60 does not move off the coil axial line L1, it is possible to use a flat washer as the first valve spring seat 51. Therefore, it is possible to simplify, and reduce the cost of, the first valve spring seat 51.

As the angle θ between the cylinder axial line L3 and the center line L4 of the inlet opening 28 of the intake port 22 is smaller, the distance between the intake port 22 and the intake valve spring 60 tends to be shorter. In the present embodiment, θ is 60 degrees or less. The engine 5 of the present embodiment is an engine in which the distance between the intake port 22 and the intake valve spring 60 is short. With such an engine, the above-described effect that a sufficient thickness of the spring support portion 17A of the cylinder head 17 can be ensured even with no protrusion on the inner wall 22W of the intake port 22 is more pronounced.

An embodiment of the present invention has been described above. However, the embodiment is merely an example. There are various other possible embodiments.

In the embodiment described above, the coil outer diameter D72 of the closely-wound section 72 of the exhaust valve spring 70 is equal to the coil outer diameter D73 of the sparsely-wound section 73. However, the coil outer diameter D72 of at least a part of the closely-wound section 72 may be smaller than the coil outer diameter D73 of the sparsely-wound section 73. In such a case, the protruding portion 24P of the inner wall of the exhaust port 24 may be eliminated. Then, it is possible to smooth the flow of the exhaust gas in the exhaust port 24. The dimensions of the cylinder head 17 and the cylinder head cover 18 in the direction of the cylinder axial line L3 may be decreased while leaving the protruding portion 24P.

Figure 6A:
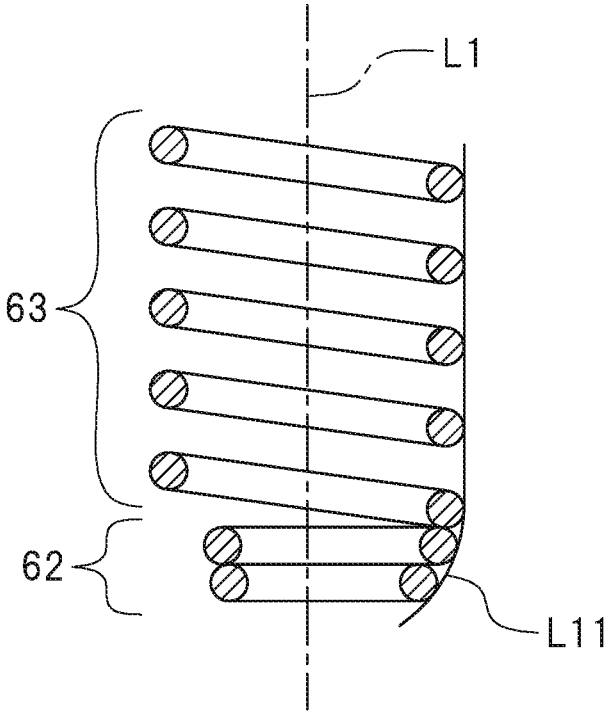
FIG. 6A is a schematic diagram showing an example of the intake valve spring.
Figure 6B:
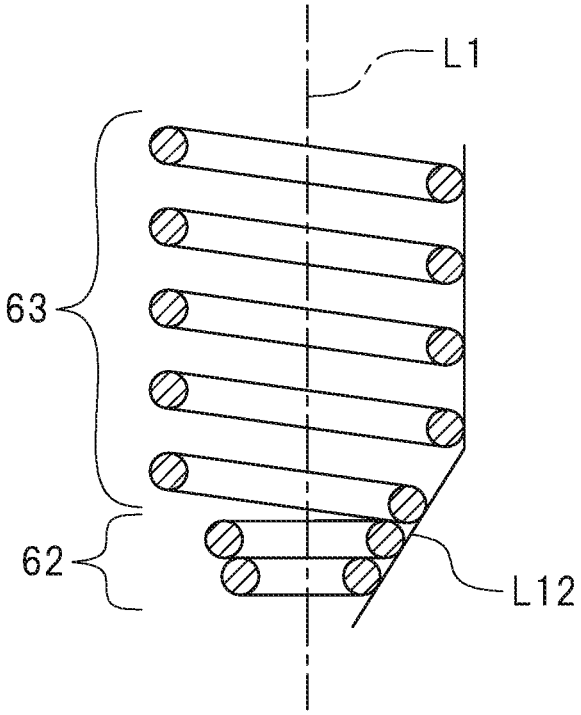
FIG. 6B is a schematic diagram showing another example of the intake valve spring.
Figure 7:
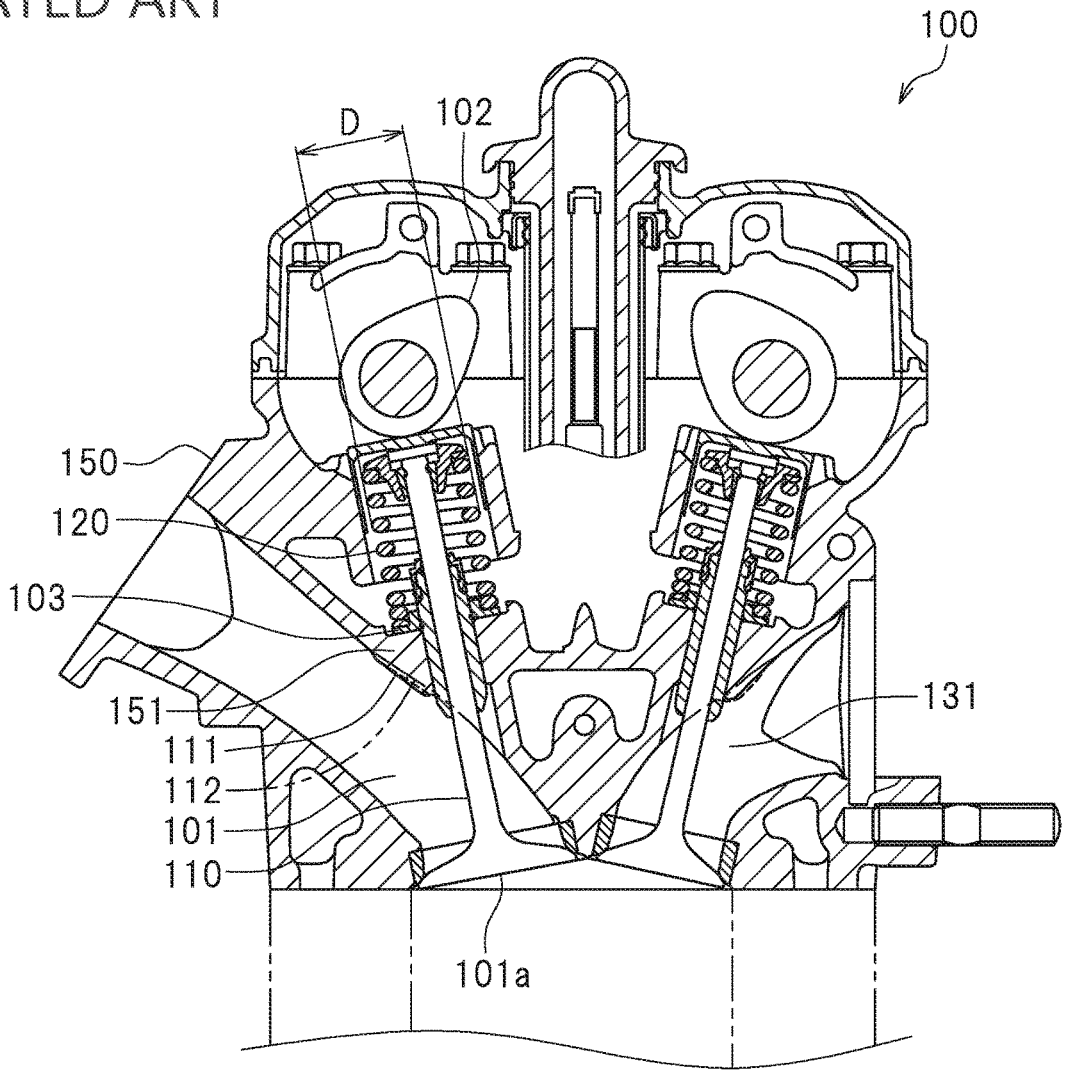
FIG.7 RELATED ART
FIG. 7 is a cross-sectional view showing a part of a conventional internal combustion engine.

As schematically shown in FIG. 6A, on a cross section that passes through the coil axial line L1, the line that connects together the outer radial edges of the elemental wire portions of the closely-wound section 62 may be the parabola L11. That is, the closely-wound section 62 may be barrel-shaped. As schematically shown in FIG. 6B, on a cross section that passes through the coil axial line L1, the line that connects together the outer radial edges of the elemental wire portions of the closely-wound section 62 may be the straight line L12. That is, the closely-wound section 62 may be cone-shaped. There is no particular limitation on the shape of the closely-wound section 62.

In the embodiment described above, the intake cam 32 is in direct contact with the valve lifter 55. The intake cam 32 is configured to directly push the valve lifter 55. However, another member such as a rocker arm may be provided between the intake cam 32 and the valve lifter 55. The intake cam 32 may be configured to indirectly push the valve lifter 55.

The first valve spring seat 51 is not limited to a flat washer. As does the third valve spring seat 53, the first valve spring seat 51 may include a disc portion having a flat ring shape, and a cylindrical portion extending in the axial direction of the valve stem 34 from the disc portion.

In the embodiment described above, the coil inner diameter d62 of at least a part of the closely-wound section 62 is equal to the outer diameter D36 of the valve guide 36. However, the coil inner diameter d62 of the closely-wound section 62 may be greater than the outer diameter D36 of the valve guide 36 for the entire length of the closely-wound section 62.

In the embodiment described above, the intake valve spring 60 is formed from a single helically-wound elemental wire 61. However, the intake valve spring 60 may be formed from two or more helically-wound elemental wires that are connected to each other.

A straddled vehicle refers to a vehicle to be straddled by a passenger. The straddled vehicle of the embodiment described above is the motorcycle 1. However, the straddled vehicle is not limited to the motorcycle 1. The straddled vehicle may be a motortricycle, an ATV (all terrain vehicle), etc.

The terms and expressions used herein are used for explanation purposes and should not be construed as being restrictive. It should be appreciated that the terms and expressions used herein do not eliminate any equivalents of features illustrated and mentioned herein, but include various modifications falling within the claimed scope of the present invention. The present invention may be embodied in many different forms. The present disclosure is to be considered as providing examples of the principles of the invention. These examples are described herein with the understanding that such examples are not intended to limit the present invention to preferred embodiments described herein and/or illustrated herein. Hence, the present invention is not limited to the preferred embodiments described herein. The present invention includes any and all preferred embodiments including equivalent elements, modifications, omissions, combinations, adaptations and/or alterations as would be appreciated by those skilled in the art on the basis of the present disclosure. The limitations in the claims are to be interpreted broadly based on the language included in the claims and not limited to examples described in the present specification or during the prosecution of the application.

REFERENCE SIGNS LIST

1: Motorcycle (straddled vehicle), 5: Internal combustion engine, 16: Cylinder body, 16*a*: Cylinder, 17: Cylinder head, 21: Intake opening (opening), 22: Intake port (port), 25: Combustion chamber, 28: Inlet opening, 32: Intake cam (cam), 33: Valve stem end, 34: Valve stem, 35: Valve body, 36: Valve guide, 51: First valve spring seat, 52: Second valve spring seat, 55: Valve lifter, 60: Intake valve spring (valve spring), 61: Elemental wire, 62: Closely-wound section, 63: Sparsely-wound section

The invention claimed is:

1. An internal combustion engine comprising:

a cylinder head provided with a port having an opening that is open toward a combustion chamber;

a cylindrical valve guide disposed in the cylinder head;

a valve having a valve stem end and a valve body end opposite to the valve stem end, the valve being configured to open and close the opening of the port, the valve including a valve stem extending straight from the valve stem end and slidably inserted into the valve guide, and a valve body provided at the valve body end of the valve and located inside the opening of the port;

a first valve spring seat supported by the cylinder head;

a second valve spring seat supported by the valve stem end of the valve;

a valve spring, which is a compression coil spring, placed between the first valve spring seat and the second valve spring seat and supported by the first valve spring seat and the second valve spring seat;

a valve lifter disposed on the valve stem end; and a cam configured to periodically push the valve lifter as the cam rotates, wherein:

the valve spring includes an array of elemental wire portions extending in a coil axial line direction, wherein each elemental wire portion represents one helical round of the valve spring, the array of elemental wire portions includes first elemental wire portions defining a closely-wound section supported by the first valve spring seat and second elemental wire portions defining a sparsely-wound section extending from the closely-wound section to the second valve spring seat, the first elemental wire portions of the closely-wound section are closely in contact with each other in the direction of the coil axial line while the valve closes the opening of the port, the second elemental wire portions of the sparsely-wound section are spaced apart from each other in the direction of the coil axial line while the valve closes the opening of the port, a first seat portion, on which one of the second elemental wire portions is supported, of the second valve spring seat has a diameter greater than a second seat portion, on which one of the first elemental wire portions is supported, of the first valve spring seat, such that a coil outer diameter of at least a part of the closely-wound section, including the one of the first elemental wire portions disposed on the first seat portion of the first valve spring seat, is smaller than a coil outer diameter of each elemental wire portion of the sparsely-wound section, including the one of the second elemental wire portions disposed on the second seat portion of the second valve spring seat, and at least a part of the closely-wound section is in direct contact with an outer surface of the valve guide.

2. The internal combustion engine according to claim 1, wherein the coil outer diameter of the closely-wound section gradually decreases toward the first valve spring seat.

3. The internal combustion engine according to claim 1, wherein the first valve spring seat is a flat washer.

4. The internal combustion engine according to claim 1, wherein a part of the valve guide is located inside the closely-wound section of the valve spring, and a coil inner diameter of at least a part of the closely-wound section is equal to an outer diameter of the valve guide.

5. The internal combustion engine according to claim 1, wherein:

the valve spring has characteristics that satisfy:

$P=k1\cdot\delta$ when load P is 0 or more and less than first load P1; and $P=k2\cdot\delta$ when load P is greater than or equal to first load P1, where P denotes load, $\delta$ denotes deformation, and k2 denotes a constant greater than a constant k1.

6. The internal combustion engine according to claim 1, wherein the port is an intake port that guides intake air into the combustion chamber.

7. The internal combustion engine according to claim 6, further comprising a cylinder body connected to the cylinder head, the cylinder body including a cylinder that defines a part of the combustion chamber, wherein the opening is an intake opening through which the intake air is guided from the intake port into the combustion chamber, the intake port includes an inlet opening that is an opening on an opposite side to the intake opening, and on a cross section of the cylinder head that passes through a center line of the cylinder and a center line of the inlet opening, an angle formed between the center line of the cylinder and the center line of the inlet opening is 60 degrees or less.

8. The internal combustion engine according to claim 1, wherein the port is an exhaust port that guides exhaust gas out of the combustion chamber.

9. The internal combustion engine according to claim 8, further comprising a cylinder body connected to the cylinder head, the cylinder body including a cylinder that defines a part of the combustion chamber, wherein the opening is an exhaust opening through which the exhaust gas is guided from the combustion chamber into the exhaust port, and the exhaust port includes an outlet opening that is an opening on an opposite side from the exhaust opening.

10. The internal combustion engine according to claim 1, wherein the array of elemental wire portions is formed from a single helically-wound elemental wire.

11. A straddled vehicle comprising an internal combustion engine according to claim 1.

12. The internal combustion engine according to claim 1, wherein the port includes an intake port that guides intake air into the combustion chamber and an exhaust port that guides exhaust air out of the combustion chamber, wherein the valve spring includes an exhaust valve spring located over the exhaust port and an intake valve spring, wherein the intake valve spring is located over the intake port, and wherein the exhaust valve spring has a uniform outer diameter.

13. The internal combustion engine according to claim 12, wherein the valve guide includes an intake valve guide and an exhaust valve guide, the cylinder head has a first spring supporting portion located between the intake port and the intake valve guide below the intake valve spring, and a second spring supporting portion located between the exhaust port and the exhaust valve guide, and a greatest thickness of a portion below the intake valve spring of the first spring supporting portion of the cylinder head is less than a greatest thickness of a portion below the exhaust valve spring of the second spring supporting portion of the cylinder head.

* * * * *